US010526769B2

(12) United States Patent
Cleophas et al.

(10) Patent No.: US 10,526,769 B2
(45) Date of Patent: Jan. 7, 2020

(54) TOOTH RETAINING AND LOCKING SYSTEM

(71) Applicant: IHC Holland IE B.V., Sliedrecht (NL)

(72) Inventors: Eugenius Petrus Elisabeth Marie Cleophas, Rotterdam (NL); Peter Cornelis Graaff, Dordrecht (NL); Roelof Breken, Gorinchem (NL)

(73) Assignee: IHC Holland IE B.V., Sliedrecht (NL)

( * ) Notice: Subject to any disclaimer, the term of this patent is extended or adjusted under 35 U.S.C. 154(b) by 0 days.

(21) Appl. No.: 15/769,744

(22) PCT Filed: Oct. 27, 2016

(86) PCT No.: PCT/NL2016/050747
§ 371 (c)(1),
(2) Date: Apr. 20, 2018

(87) PCT Pub. No.: WO2017/074187
PCT Pub. Date: May 4, 2017

(65) Prior Publication Data

US 2018/0305904 A1 Oct. 25, 2018

(30) Foreign Application Priority Data

Oct. 28, 2015 (NL) ..... 2015672

(51) Int. Cl.
*E02F 9/28* (2006.01)
*E21C 35/193* (2006.01)

(52) U.S. Cl.
CPC ..... *E02F 9/2841* (2013.01); *E02F 9/2825* (2013.01); *E02F 9/2866* (2013.01); *E21C 35/1936* (2013.01)

(58) Field of Classification Search
CPC ..... E02F 9/2825; E02F 9/2833; E02F 9/2841; E02F 9/2858; E02F 9/2866; E21C 35/19; E21C 35/1936
See application file for complete search history.

(56) References Cited

U.S. PATENT DOCUMENTS 1,783,350 A * 12/1930 Ralph ..... E02F 9/2825 37/454
2,220,819 A * 11/1940 Johnson ..... E02F 3/8152 37/449
2,311,463 A 2/1943 Page
2,385,395 A * 9/1945 Josef ..... E02F 9/2833 37/458
2,393,706 A * 1/1946 Page ..... E02F 9/2833 37/455
2,925,673 A * 2/1960 Sennholtz ..... E02F 9/2825 37/455
3,286,378 A * 11/1966 Benetti ..... E02F 9/2841 37/457

(Continued)

FOREIGN PATENT DOCUMENTS

CN 103174187 B 4/2015

*Primary Examiner* — Matthew Troutman
(74) *Attorney, Agent, or Firm* — N.V. Nederlandsch Octrooibureau; Catherine A. Shultz; Tamara C. Stegmann

(57) ABSTRACT

A tooth with a retaining system for retaining the tooth in a receiving portion of an adapter in a cutting system comprises a first holding system to releasably retain the tooth to the adapter; and a second holding system to tension and secure the tooth with respect to the adapter.

18 Claims, 5 Drawing Sheets

(56) References Cited

U.S. PATENT DOCUMENTS

| | | | | | |
|---|---|---|---|---|---|
| 3,357,117 | A * | 12/1967 | Petersen | A01B 15/025 | 172/762 |
| 4,205,469 | A * | 6/1980 | Johansson | E02F 3/9212 | 37/457 |
| 4,261,619 | A | 4/1981 | Howe et al. | | |
| 4,536,037 | A | 8/1985 | Rink | | |
| 5,184,412 | A * | 2/1993 | Kopinski | E02F 9/2841 | 37/457 |
| 5,713,145 | A * | 2/1998 | Ruvang | E02F 9/2833 | 37/455 |
| 6,209,238 | B1 * | 4/2001 | Ruvang | E02F 9/2825 | 37/455 |
| 6,240,663 | B1 * | 6/2001 | Robinson | E02F 9/2825 | 37/455 |
| 7,690,136 | B2 | 4/2010 | Breken | | |
| 7,694,443 | B2 | 4/2010 | Gabela et al. | | |
| 2009/0000159 | A1 | 1/2009 | Breken | | |
| 2009/0277050 | A1 | 11/2009 | Ollinger, IV et al. | | |
| 2013/0076102 | A1 | 3/2013 | Pizzato et al. | | |
| 2014/0159467 | A1 | 6/2014 | Bookhamer et al. | | |
| 2014/0202049 | A1 * | 7/2014 | Ruvang | E02F 9/2841 | 37/453 |
| 2017/0073939 | A1 * | 3/2017 | Bjerke | E02F 9/2808 | |

* cited by examiner

TOOTH RETAINING AND LOCKING SYSTEM

BACKGROUND

During cutting operations; such as dredging, excavating, trenching, tunneling, mining operations, etc.; tooth systems and teeth are subject to large cutting forces (e.g., when hitting a piece of hard rock), which results in large material stresses and eventually causes teeth to wear down and/or break off. Because of this, teeth have to be changed frequently. Current locking systems to secure teeth to adapters typically use a threaded rod which must be tightened to secure the two together. One such system is found in CN103174187, which shows a tooth for excavator machinery. The tooth includes an integral wing which extends from a back of the tooth. A snap ring can be secured around the wing to secure the tooth to the holder.

A connection system for cutting teeth for a strip mining system is shown in U.S. Pat. No. 4,536,037. The detachable cutting teeth in such a system are received within receptacles and are connected with pins extending in a direction perpendicular to the receptacle. The teeth also include rubber rivets extending from the side walls, though these are to provide resilient, shock-absorbing force to reduce shifting of the teeth when inserted and do not form part of the retaining system. The teeth are locked and held in place using retaining pins which extend through a channel within the side walls and through the teeth.

Another connection system for a tooth is shown in US2009/0000159, which discloses a tooth that slides into an adaptor, and is held in place with locking means. The locking means connect to the adaptor and form part of the tooth, and can be a hook connection.

Due to the weight of a tooth in such systems, the changing of teeth typically requires two people for connecting or disconnecting a tooth. One person must hold the tooth while the other person works to connect or loosen the tooth from the connector or locking system. In other systems, teeth can be mounted on only one side of the cutter or the teeth will fall out of the adapter due to these issues. Thus, the time and/or persons required for changing teeth can be significant.

SUMMARY

A tooth with a retaining system for retaining the tooth in a receiving portion of an adapter in a cutting system comprises a first holding system to releasably retain the tooth to the adapter; and a second holding system to tension and secure the tooth with respect to the adapter. By having first and second holding systems—one to hold the tooth with respect to the adapter and one to tension the tooth, tooth can be more efficiently mounted and dismounted from adapter. This allows for more flexible mounting, for example, by only one person and/or on any side of a cutting system because the first holding system is able to easily hold the tooth with respect to the adapter, thereby preventing the tooth from simply falling out of the adapter once untensioned unless a second person is used and/or positioned in a specific place around a cutting system when untensioned.

According to an embodiment, the first holding system comprises a compressible retention element which fits within and corresponds at least in part to a shape of a mounting portion to stay within the mounting portion once inserted. Using a compressible retention element which fits within and corresponds at least in part to a shape of a mounting portion as part of first holding system allows for retention from an inside position in a flexible manner which resists wear. Because the flexible compression element is located within tooth and/or adapter, it is subject to less wear, and may be reusable.

According to an embodiment, the second holding system comprises a locking device. Optionally, the locking device can be a locking nut and/or other members which can tension and secure the tooth to the adapter.

According to an embodiment, the system further comprises an operating member extending through a hole in the longitudinal direction of the tooth; and a locking plate which can connect to the operating member in a direction perpendicular to the longitudinal direction of the operating member and tooth. The first holding system releasably secures the tooth to the adapter using the operating member connecting through the compressible retention element in the mounting portion and/or using the locking plate; and the second holding system secures the tooth to the adapter through the locking device tensioning the tooth to the adapter. Such a system allows for both a holding system, and a tensioning system, which can make for an easier and more efficient process for mounting and dismounting a tooth from an adapter.

According to an embodiment, the locking plate comprises a slot and/or a hole which fits around the operating member. A slot can allow the locking plate to slide around the locking member. A hole can connect the locking plate to the operating member, allowing for the locking plate to stay connected to the locking member and rotate around it to be oriented one way for inserting/disconnecting the tooth with respect to the adapter, and oriented a different way to secure the tooth with respect to the adapter once inserted.

According to an embodiment, the operating member comprises a head at one end. The head can sit on one end of the compressible retention element to secure the operating member to the compressible retention element.

According to an embodiment, the mounting portion of the tooth comprises a cavity. According to an embodiment, the operating member extends at least a portion of the length of the hole and the tooth mounting portion when inserted.

According to an embodiment, the operating member is a rod or screw. Optionally, the operating member comprises threads on all or part of the operating member. A locking nut can connect to the threads and be used to tension or untension the tooth from the adapter. According to an embodiment, the locking device comprises a locking nut and the operating member can secure the tooth to the adapter by tightening the nut and/or the operating member.

According to an embodiment, the locking plate is slid around the operating member between an end of the tooth and the locking device. Optionally, the locking plate is inserted through a slot in the adapter. Another option is that the locking plate is connected to the operating member through a hole in the locking plate and can rotate with respect to the operating member. By sliding or rotating the locking plate around the operating member, it can be a stop to secure the tooth to the adapter in the proper position. It is then easily incapacitated by either removing the locking plate by sliding it in the opposite direction or rotating the locking plate to remove the tooth from the adapter when desired.

According to an embodiment, the locking device protrudes from a back end of the tooth when the operating member is inserted into the hole. This can be from a shank portion of the tooth. This can allow for easy tensioning and securing of the tooth to the adapter.

According to an embodiment, the compressible retention element comprises a flexible material. This can be, for example, rubber or a rubber like material. Rubber or another compressible material can allow for the operating member with head to connectthrough the compressible retention element but to be able to secure at an end. In some embodiments, a washer or other element could be used between compressible retention element and head to ensure head does not pull back through compressible retention element if used to tension and secure tooth to adapter. The flexible material also allows for compression when inserting or removing the tooth from the adapter and then for it to frictionally connect between the tooth and adapter when the tooth is inserted into the adapter.

According to an embodiment, the mounting portion and the compressible retention element are both substantially elongated in shape. This can be rectangular, cylindrical or another shape. By having at least a part of mounting portion and compressible retention element be complementary in shape, compressible element can be sure to securely hold tooth to adapter in position when desired. In other embodiments, compressible retention element and/or mounting portion can have a different shape.

According to an embodiment, the first holding system and/or the second holding system further comprises one or more washers. Such washers can assist in securing holding system components with respect to each other, particularly when securing and tensioning. According to an embodiment, the compressible retention element comprises a plurality of compressible retention elements. One or more compressible retention elements could be used to give proper shaped/length desired and/or to give properties desired for first and/or second holding system.

According to an embodiment, the first holding system and the second holding system are separate systems. By using completely separate systems that do not have common components, first and second holding systems are not dependent on each other and can ensure holding of tooth with respect to adapter even if a component of one system were to fail. Furthermore, separating systems could allow for usage of tooth locking systems with a variety of different teeth and adapters, making a more flexible overall system.

According to an embodiment, the tooth mounting portion extends to one or both sides of the tooth. This can allow for easy insertion of compressible retention element.

According to an embodiment, the tooth comprises a shank shaped complementary to an adapter receiving portion such that the shank slides into the adapter receiving portion in a longitudinal direction.

According to an embodiment, the first holding system retains the tooth to the adapter using a frictional force.

According to an embodiment, the compressible retention element extends wider than the mounting portion. This extension wider than the mounting portion can cause the compressible retention element to extend outside a shank of the tooth and come into frictional contact with the adapter when inserted, holding the tooth with respect to the adapter. In some embodiments, the adapter could include a notch or other structure to receive the compressible retention element for further holding the tooth with respect to the adapter.

According to an embodiment, the first holding system is surrounded by the tooth and/or adapter when the tooth is inserted into the adapter. By ensuring the first holding system is surrounded by the tooth and/or adapter, components are protected from wear, and can have a longer life. Additionally, at least some components could be reusable. According to an embodiment, an adapter comprises such a tooth with retaining system.

According to an embodiment, a tooth shank slides longitudinally into the adapter to fit at least substantially within the adapter.

According to an embodiment, the adapter comprises a slot for receiving a locking plate. Such an embodiment give a flexible range of options for connection and securing the locking plate with respect to the tooth and/or the adapter.

According to an embodiment, a cutter head comprises such a tooth with retaining system. This can allow for more efficient and flexible mounting and dismounting of the tooth in the cutter head. By having first and second holding system, first system is able to releasably retain the tooth in the proper position with respect to the adapter even when tooth is untensioned, thereby allowing for mounting or dismounting by a single person and/or at any side of the cutter head, thereby allowing multiple persons to mount/dismount teeth at the same time.

According to a second aspect of the invention, a method of connecting a retaining system to a tooth with a tooth mounting portion comprises inserting a compressible retention element in the tooth mounting portion. Optionally, this method can further comprise inserting a retaining mechanism into a hole for holding the compressible retention element. Further optionally, this could comprise inserting an operating member into the hole such that the compressible retention element secures around and to the operating member and that a first end of the operating member, which comprises a locking device, protrudes from the tooth. Alternatively, the retaining mechanism could take a different form.

Such a method allows for mounting at least some components of a holding system for a tooth, in advance if desired. This can result in a more efficient mounting and dismounting process for the tooth when needed.

According to a further aspect of the invention, a method of releasably connecting a tooth to an adapter comprises sliding a tooth shank into an adapter receiver space; engaging a tooth with an adapter with a first holding system; and tensioning and securing the tooth to the adapter with a second holding system. By using first and second holding systems, tooth is able to connect to adapter in a proper position and separately tension to the adapter. This allows for tooth to stay connected to the adapter even when untensioned, allowing for more efficient and more flexible mounting and dismounting of the tooth from the adapter. The mounting or dismounting can be done by one person and/or on a side of a cutting system that would normally be affected by gravity because tooth continues to stay connected to adapter when untensioned, and then first holding system can easily release tooth when desired.

According to an embodiment, the step of engaging a tooth with an adapter with a first holding system comprises inserting a compressible retention element in the tooth mounting portion. Optionally, this can further comprise inserting an operating member into the hole such that the compressible retention element secures around and to the operating member and that a first end of the operating member comprising a locking device protrudes from an end of the tooth. One or both of these steps can be done at the moment of inserting the tooth into the adapter or well in advance, offering an even faster mounting process. Optionally, the method further comprises rotating a locking plate around the operating member or sliding a locking plate with a slot around the operating member in a direction perpendicular to the longitudinal direction of the operating member. These elements can work together as a quick release system for holding the tooth in place with respect to the adapter even if untensioned.

According to an embodiment, the step of tensioning and securing the tooth to the adapter with a second holding system comprises tightening the locking device to secure the tooth with respect to the adapter. Such a locking device, can be, for example, a locking nut and/or other components to secure tooth to adapter.

DETAILED DESCRIPTION

Figure 1A:
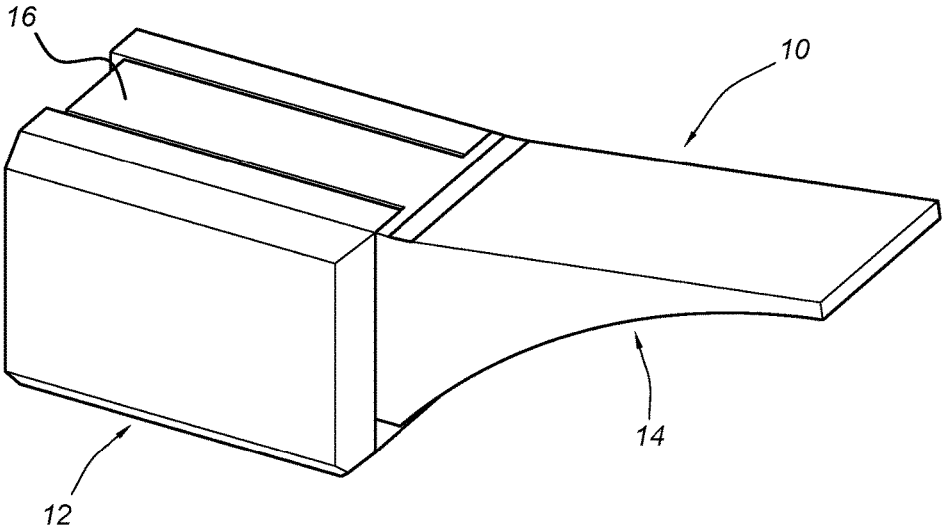
FIG. 1A is a perspective view of a tooth and adapter.
Figure 1B:
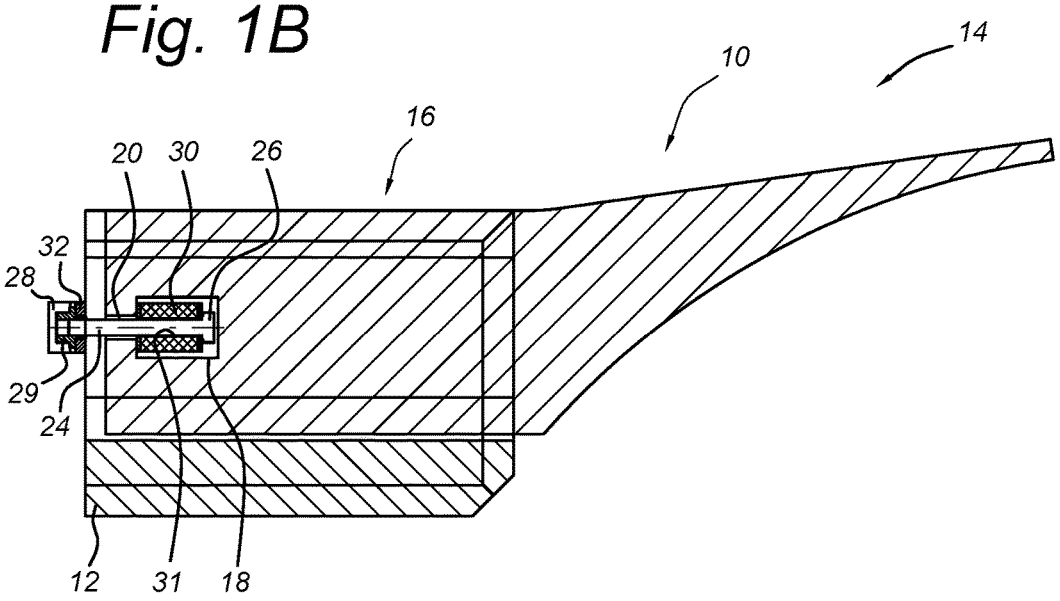
FIG. 1B cross-sectional view of the tooth and adapter of FIG. 1A.
Figure 1C:
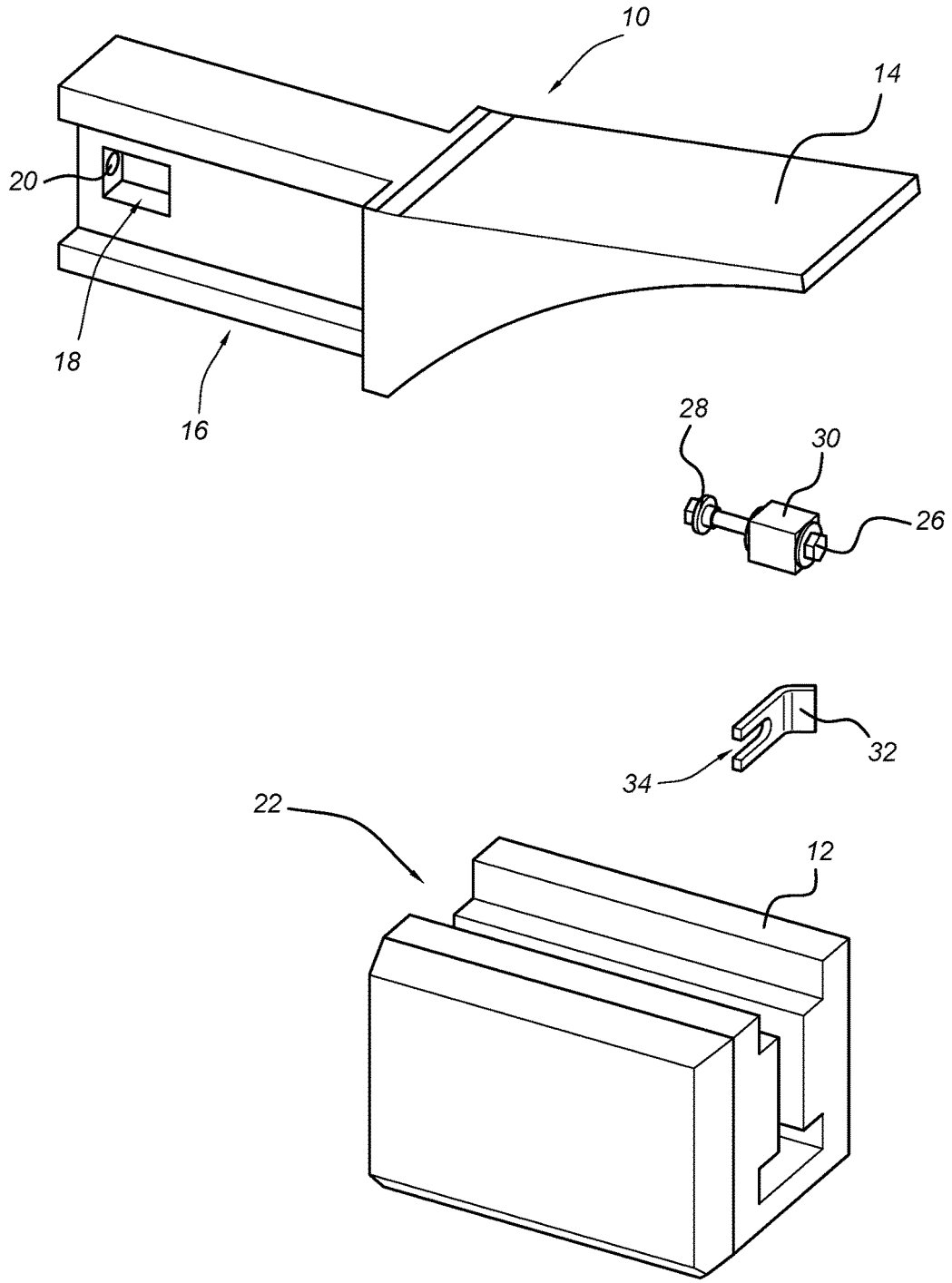
FIG. 1C is an exploded view of the tooth and adapter of FIG. 1A.

FIG. 1*a* is a perspective view of tooth 10 and adapter 12, FIG. 1*b* cross-sectional view of tooth 10 and adapter 12, and FIG. 1*c* is an exploded view of tooth 10 and adapter 12. Tooth 10 and adapter 12 can be used in a variety of systems, for example, cutting systems for mining, dredging, trenching, etc. Such systems can be, for example, cutter heads, drag heads, excavators, backhoes, mining ROV's, tunneling machines, cutter wheels, etc.

FIGS. 1*a*-1*c* include tooth 10 with cutting portion 14 and shank 16 with mounting portion 18 and hole 20; adapter 12 with receiving portion 22; operating member 24 with head 26 and locking nut 28; washer 29; compressible retention element 30; and locking plate 32 with slot 34.

Mounting portion 18 is a cavity in shank 16 of tooth 10 which is rectangular in shape and open to the sides of shank 16. In other embodiments, mounting portion 18 could be open to only one side and/or a different shape. Hole 20 extends in shank 16, in this embodiment, a longitudinal direction from an end of shank 16.

Compressible retention element 30 is rectangular in shape, corresponding at least in part to the shape of tooth mounting portion 18 such that compressible retention element 30 fits into tooth mounting portion 18 (and can extend to one or both sides beyond the tooth mounting portion 18), and is retained within tooth mounting portion 18. Compressible retention element is rectangular shaped, though could be other shapes in other embodiments. Compressible retention element 30 can be formed of any compressible material, for example rubber, and could be formed from one compressible retention element or more than one compressible retention element either connected together or simply pressed together. Compressible retention element 30 includes a channel 31 through element 30.

Operating member 24 can be a rod or a screw, and can include threads on all or part of operating member 24. Head 26 is located at one end of operating member 24 and locking nut 28 can be connected at a second end of operating member 24. Washer 29 can be located adjacent to locking nut 28. In some embodiment, a washer could be placed between compressible retention element 30 and head 26. Operating member 24 is sized to fit through hole 20 and through a hole in compressible retention element 30.

Locking plate 32 can take a variety of shapes and sizes, and includes slot 34. Locking plate 32 is shaped and/or sized such that operating member 24 can fit into slot 34 when locking plate 32 is slid perpendicularly to the longitudinal direction of tooth 10, but that locking nut cannot fit through slot 34.

Figure 2B:
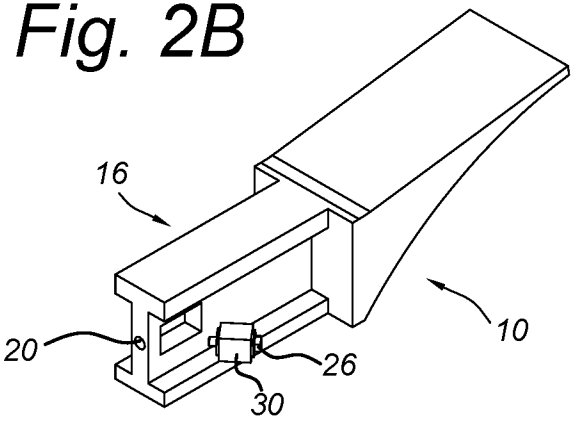
FIGS. 2A-2H show perspective and cross-sectional views of a part of the assembly process for a tooth and holding system.
Figure 2D:
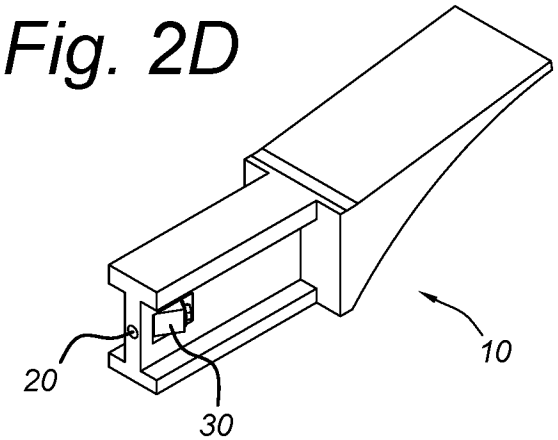
Figure 2A:
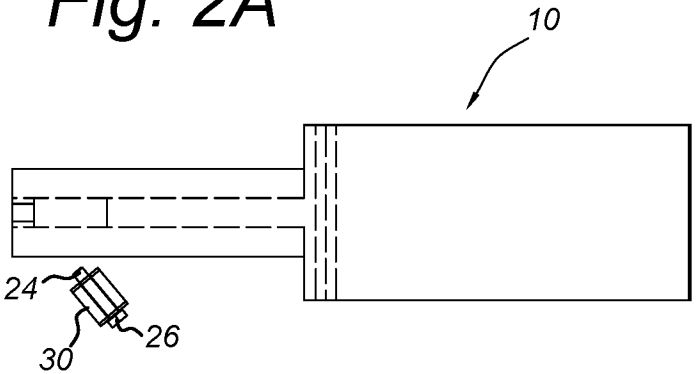
Figure 2C:
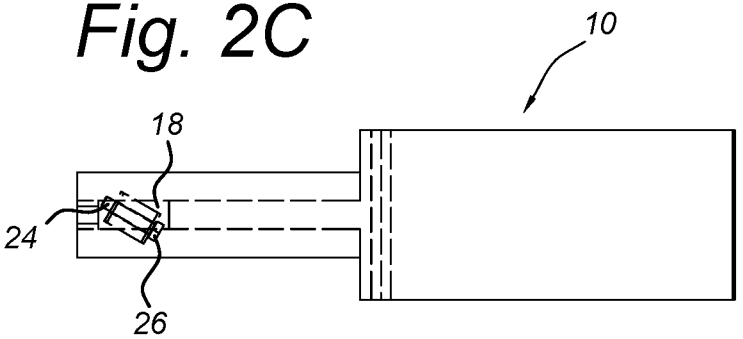
Figure 2F:
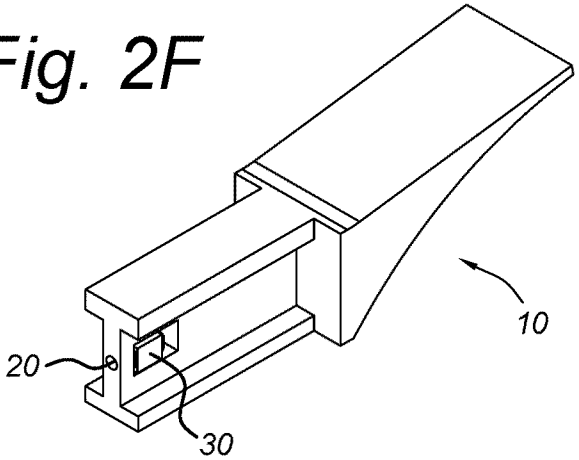
Figure 2H:
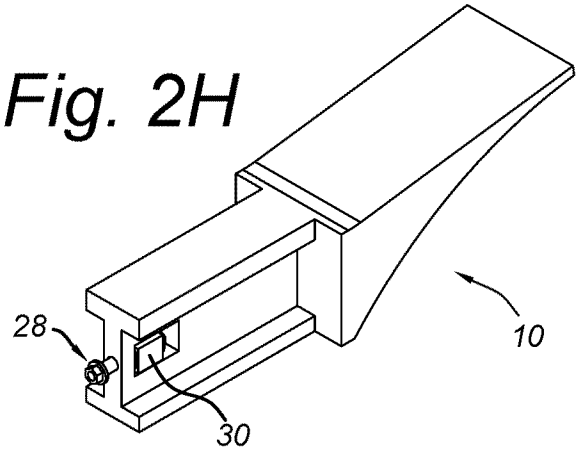
Figure 2E:
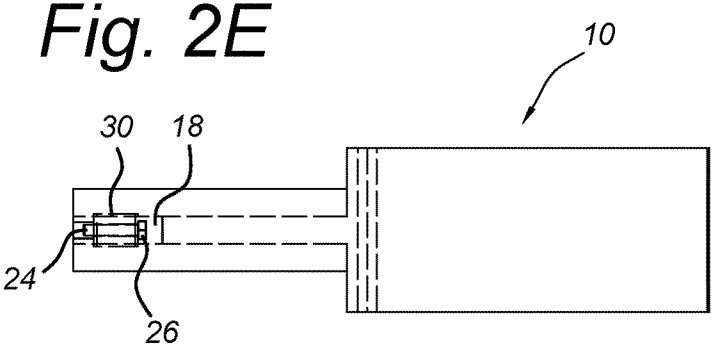
Figure 2G:
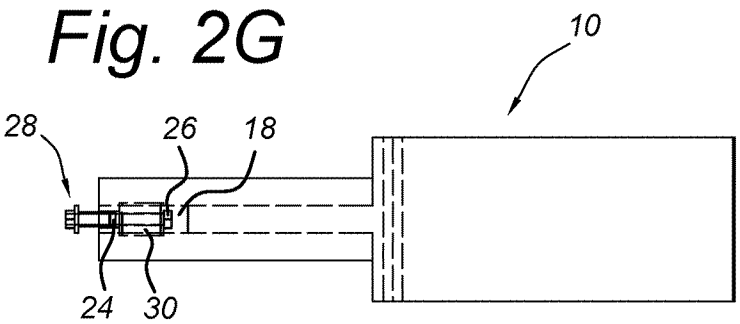

FIGS. 2A-2H show the steps for connecting the compressible retention element 30 and operating member 24 to tooth 10. FIGS. 2A-2B, 2C-2D, 2*e*-2F, and 2G-2H respectively show cross-sectional and perspective views at particular steps of assembly. For the operation of first and second holding system to hold and tension or secure tooth 10 to adapter 12, operating member 24 (with locking nut 28 temporarily disconnected) can connect through the hole in compressible retention element 30, as shown in FIGS. 2A-2B. Then, compressible retention element 30 with operating member 24 slides into mounting portion 18 of shank 16, with operating member 24 sliding into hole 20 (FIGS. 2C-2F). This can be from one of the side openings, and the combination can be tilted to fit. Operating member 24 is inserted through hole 20 with the second side (to which locking nut 28 is going to connect) extending through hole 20 towards the end of tooth 10. Depending on the system, it may or may not extend out of hole 20 for locking nut 28 connection. Locking nut 28 can then be connected to operating member 24 (FIGS. 2G-2H).

Head 26 sits on a far side of compressible retention element 30, with head securing operating member 24 to compressible retention element 30 and compressible retention element 30 ensuring that operating member stays in hole 20 and connected to tooth 10 shank 16. Locking nut 28 connects at an end of tooth 10 shank 16, protruding from hole 20 when operating member 24 has been inserted with compressible retention element 30. As can be seen in FIG. 1*b*, in this embodiment, operating member 24 extends longitudinally at least a part of the length of hole 20 and mounting portion 18 when inserted. The insertion of compressible retention element 30 and/or operating member 24 can be performed at any time prior to mounting of tooth 10 into adapter 12, for example, immediately before mounting or long before mounting, for example, when tooth 10 is produced.

Tooth 10 then connects to adapter 12 by shank 16 sliding longitudinally into adapter 12 receiving portion 22. Compressible retention element 30 makes a frictional connection with adapter 12 once tooth 10 is inserted. Locking plate 34 can be slid in a perpendicular direction around operating member 34 so that operating member 24 sits within slot 34. This can be at an end of shank 16 as shown in FIG. 1*b*, or adapter 12 could have a slot through which locking plate 32 can slide to connect around operating member 24. Locking plate 32 connects and extends in such a way that it prevents tooth 10 from sliding out of adapter 12. In FIG. 1*b*, this is done by connecting at an end of shank 16 such that locking plate 32 sits adjacent to locking nut 28 and that locking plate 32 extends over an end of adapter 12 as well. At least the end of locking nut 28 cannot fit through slot 34 of locking plate 32. Thus, compressible retention element 24 connects and secures tooth 10 to operating member 24, and locking plate 32 secures operating member 24 to adapter 12, ensuring that tooth 10 cannot slide out of adapter 12 receiving portion 22. Tooth 10 can then be tensioned to adapter 12 by tightening locking nut 28. This will pull tooth 10 toward locking nut 28 and locking plate 32 by head 26 pulling against compressible retention element 30, which pulls against mounting portion 18 in shank 16, securing and tensioning tooth 10 with respect to adapter 12.

To release tooth 10 from adapter 12, locking nut 28 can be loosened. Tooth 10 will still be held in adapter 12 through operating member 24, compressible retention element 30 and locking plate 32. Locking plate 32 can be removed by sliding out, and tooth 10 will be able to slide out of adapter 12 longitudinally.

By using two holding systems, tooth 10 can be either relatively loosely retained within adapter 12, or tensioned and secured with respect to adapter 12. This can allow for easier and quicker mounting or unmounting of teeth 10, and for such operations by a single person. Compressible retention element 30 and/or operating member 24 can be inserted into shank 16 in advance of mounting tooth 10 to adapter 12. Compressible retention element 30 in the mounting portion 18 secures the tooth 10 to operating member 24 through head 26 and to adapter 12 in a frictional manner, and locking plate 32 connects in such a way that it secures operating member 24 to adapter 12 in the longitudinal direction, thereby securing tooth 10 to adapter 12. Second holding system then uses locking nut 28 to tension tooth 10 with respect to adapter 12, securing the components for a cutting or digging operation. Such first and second holding systems allow for quicker connection and disconnection of teeth, and allow for such operations to be performed by only one person. Additionally, by keeping locking elements substantially within the tooth and adapter, they are subjected to much less wear, and may be reuseable with other teeth, particularly the compressible retention element.

Furthermore, as described above, current and past tooth retention systems typically only use one holding/locking system. Thus, when the system is untensioned, the tooth falls out if it is on a particular side of a cutting system, such as a cutter head or other system (due to gravity). By using first and second holding systems, tooth 10 can be retained within adapter 12 even when untensioned, allowing for changing of teeth on all sides of a cutting system. This can result in a much more efficient tooth changing process.

Figure 3:
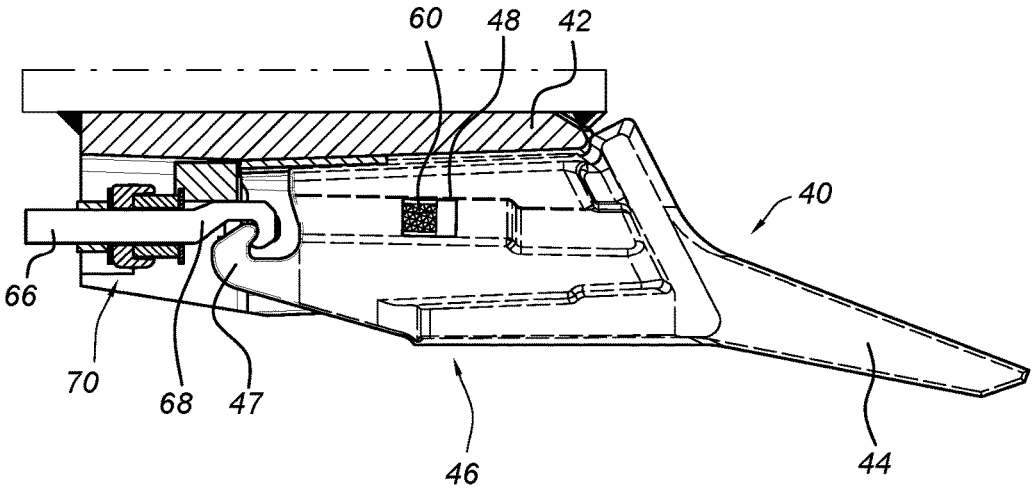
FIG. 3 is a cross-sectional view of a second embodiment of a tooth and adapter.

FIG. 3 is a cross-sectional view of a second embodiment of a tooth 40 and adapter 42. Tooth 40 includes cutting portion 44 and shank 46 with mounting portion 48. Also shown is compressible retention element 60. In some embodiments, an operating member with locking nut could be used.

Compressible retention element 60 sits within mounting portion 48 and is retained within mounting portion 48 due to the size and/or shape of compressible retention element 60 and mounting portion 48. Compressible retention element 60 is wider than mounting portion 48, and extends to the sides of shank 46. Mounting portion 48 extends to both sides of tooth 40 for insertion of compressible retention element 60. When tooth 40 slides into adapter 42, compressible retention element 60 is compressed for the sliding into place, and then retains tooth 40 to adapter 42 through a friction force.

Second holding system, which can tension and secure tooth 40 to adapter 42, includes threaded rod 66 with hook 68 and nut 70. Hook 68 can connect to a complementary hook 47 on shank 46, and nut 70 can tighten to tension and secure tooth 40 to adapter 42 through the connection between hooks 68, 47.

In this embodiment, first holding system and second holding system are completely separate systems, which do not share common parts. First holding system retains tooth 40 to adapter 42 through compressible retention element 60 in mounting portion 48; and ensures that tooth 40 stays connected to adapter 42 when desired through frictional force between compressible retention element 60 and adapter 42. Second holding system tensions and secures tooth 40 with respect to adapter 42 through hooks 68, 47 and nut 70.

First holding system is a system which is easy to insert and connect to hold tooth 40 in proper position with respect to adapter 42. Similar to the embodiment in FIGS. 1*a*-1*c*, the use of first and second holding systems allows for quicker and more flexible mounting and dismounting of tooth 40 from adapter 42. This can enable mounting/dismounting by a single person and/or from any side of a cutting system such as a cutter head or other device with which the tooth and adapter is being used.

Figure 4A:
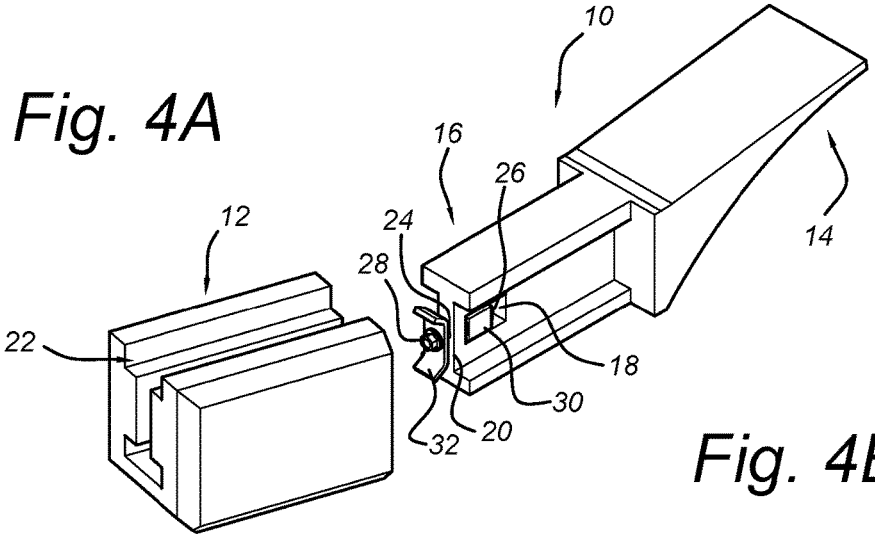
FIG. 4A is a perspective view of a tooth and adapter with an alternative embodiment for a tooth locking system.
Figure 4B:
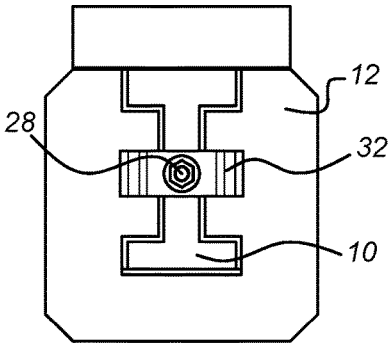
FIG. 4B is a back view of the system of 4A with the tooth connected to the adapter.

FIG. 4A is a perspective view of tooth 10 and adapter 12 with an alternative embodiment for a tooth locking system, and FIG. 4B is a back view of the system of 4A with tooth 10 connected to adapter 12. Similar parts are labelled the same as in FIGS. 1A-1C.

Tooth 10 includes cutting portion 14 and shank 16 with mounting portion 18 and hole 20. Adapter 12 includes receiving portion 22. Also shown are operating member 24 with head 26 and locking nut 28; compressible retention element 30; and locking plate 32 with slot 34.

Tooth 10, adapter 12 and locking system work very similarly to the system of FIGS. 1A-1C, with the exception that locking plate 32 stays connected to operating member 24 through a hole or slot, and is rotatable with respect to operating member 24. As shown in FIG. 4A, locking plate 32 can be rotated in a vertical direction for insertion or removal of tooth 10 from adapter 12. When tooth 10 is properly positioned in adapter 12, locking plate 32 can be rotated as shown in FIG. 4B to retain tooth 10 to adapter 12. This system allows for locking plate 32 to stay connected to tooth 10, removing the possibility of losing and/or dropping the locking plate 32.

While different types of holding systems are shown in FIGS. 1A-3, these are merely example embodiments, and are not meant as limiting. For example, the embodiments shown in FIGS. 1A-2D and FIG. 3 could have a different type of first and/or second holding system. By having at least one of the holding systems include a substantial number of components located inside the tooth, components can also be inserted in advance, promoting an even quicker installation process. This can also reduce the wear on the components, allowing for their reuse with other teeth and other systems, particularly the compressible retention element. The use of a compressible retention element can also help resist wear on the tooth, adapter and/or other components, ensuring a longer useful life for holding system(s) and overall tooth and adapter.

The use of two holding systems, one which is easily releasable and can keep the tooth in the correct position (and which can use a compressible retention element in a mounting space within the tooth) and one which can tension and secure the tooth allows for a more flexible system which is simpler, quicker and can be safer for connecting and/or disconnecting a tooth to an adapter.

Specific teeth 10, 40 and adapters 12, 42 are shown for example purposes only, and tooth locking system could work with a number of teeth and adapters. Similarly, the specific mechanical connections and set-up of holding systems are also for example purposes, and can vary depending on different system requirements.

While an operating member is shown to hold the compressible retention element, the compressible element could be retained in another way, for example, by another device, and/or simply retained in mounting portion through the shapes and/or sizes of compressible retention element and mounting portion.

While the hole 20 and operating member 24 are shown in FIGS. 1A-2H as extending in the longitudinal direction of the tooth, in other embodiments, first holding system and/or second holding system could extend perpendicular to the longitudinal direction of tooth. Operating member (if used) could extend perpendicularly to the longitudinal direction of the tooth, with the operating member locking nut protruding, for example, from the adapter. In some embodiments, for tensioning movement requirements, the hole which the operating member extends through in the adapter may have to be expanded and/or be more of a channel to allow the operating member to move longitudinally as the tooth is being tensioned with respect to the adapter.

While the compressible retention element is shown as sitting within the mounting portion, in other embodiments, compressible retention element could sit within a portion of adapter to form a frictional connection between the tooth and adapter.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the appended claims.

The invention claimed is:

1. A tooth with a retaining system for retaining the tooth in a receiving portion of an adapter in a cutting system, the tooth with retaining system comprising:

a first holding system to releasably retain the tooth to the adapter, the first holding system comprising a compressible retention element which fits within and corresponds at least in part to a shape of a mounting portion in the tooth to stay within the mounting portion once inserted; and a second holding system to tension and secure the tooth with respect to the adapter, the second holding system comprising a locking device and an operating member extending in the longitudinal direction of the tooth, wherein the compressible retention element is secured in the mounting portion of the tooth prior to insertion into the adapter.

2. The tooth with retaining system of claim 1, wherein the operating member extends through a hole in the longitudinal direction of the tooth; the tooth with retaining system further comprising:

a locking plate which can connect to the operating member in a direction perpendicular to the longitudinal direction of the operating member and tooth;

wherein the first holding system releasably secures the tooth to the adapter using the operating member connecting through the compressible retention element in the mounting portion and/or using the locking plate; and wherein the second holding system secures the tooth to the adapter through the locking device tensioning the tooth to the adapter.

3. The tooth with retaining system of claim 2, wherein the locking plate comprises a slot or a hole which fits around the operating member; and wherein the locking plate is slid around the operating member between an end of the tooth and the locking device.

4. The tooth with retaining system of claim 2, wherein the operating member comprises a head at one end; and wherein the mounting portion of the tooth comprises a cavity.

5. The tooth with retaining system of claim 2, wherein the operating member extends at least a portion of the length of the hole and the tooth mounting portion when inserted; and wherein the locking device protrudes from the back end of the tooth when the operating member is inserted into the hole.

6. The tooth with retaining system of claim 2, wherein the operating member is a rod; and wherein the operating member comprises threads.

7. The tooth with retaining system of claim 2, wherein the locking device comprises a locking nut and the operating member can secure the tooth to the adapter by tightening the nut and/or the operating member.

8. The tooth with retaining system of claim 2, wherein the locking plate is inserted through a slot in the adapter.

9. The tooth with retaining system of claim 2, wherein the locking plate is connected to the operating member through a hole in the locking plate and can rotate with respect to the operating member.

10. The tooth with retaining system of claim 1, wherein the compressible retention element comprises a flexible material; and wherein the tooth mounting portion and the compressible retention element are both substantially elongated in shape.

11. The tooth with retaining system of claim 1, wherein the first holding system and/or the second holding system comprises one or more washers; and wherein the first holding system and the second holding system are separate systems.

12. The tooth with retaining system of claim 1, wherein the tooth comprises a shank shaped complementary to an adapter receiving portion such that the shank slides into the adapter receiving portion in a longitudinal direction;

wherein the first holding system retains the tooth to the adapter using a frictional force; and wherein the first holding system is surrounded by the tooth and/or an adapter when the tooth is inserted into the adapter.

13. An adapter with tooth with a retaining system of claim 1, wherein a tooth shank slides longitudinally into the adapter to fit at least substantially within the adapter; and wherein the adapter comprises a slot for receiving a locking plate.

14. Method of connecting a retaining system to a tooth with a tooth mounting portion, the method comprising:

inserting a compressible retention element in the tooth mounting portion, the compressible retention element configured to fit within and correspond at least in part to a shape of the mounting portion to stay within the mounting portion once inserted in the mounting portion and prior to insertion of the tooth into an adapter; and inserting an operating member through the compressible retention element and into a hole extending in the longitudinal direction of the tooth for holding the compressible retention element.

15. A method of releasably connecting a tooth to an adapter, the method comprising:

inserting a compressible retention element into a tooth mounting portion; wherein the compressible retention element fits within and corresponds at least in part to a shape of the tooth mounting portion and is retained within the mounting portion once inserted prior to insertion of the tooth into the adapter;

sliding a tooth shank into an adapter receiver space;

engaging a tooth with an adapter with a first holding system comprising the compressible retention element; and tensioning and securing the tooth to the adapter with a second holding system comprising a locking device and an operating member extending in a longitudinal direction of the tooth.

16. The method of claim 15, and further comprising:

inserting an operating member into a hole extending in the longitudinal direction of the tooth such that the compressible retention element secures around and to the operating member, wherein a first end of the operating member comprises the locking device protruding from an end of the tooth; and sliding a locking plate with a slot around the operating member in a direction perpendicular to the longitudinal direction of the operating member.

17. The method of claim 16, and further comprising:

rotating the locking plate connected around the operating member.

18. The method of claim 15, wherein the step of tensioning and securing the tooth to the adapter with a second holding system comprises:

tightening the locking device to secure the tooth with respect to the adapter.

* * * * *